United States Patent [19]

Baglione

[11] Patent Number: 4,505,125

[45] Date of Patent: Mar. 19, 1985

[54] SUPER-HEAT MONITORING AND CONTROL DEVICE FOR AIR CONDITIONING REFRIGERATION SYSTEMS

[76] Inventor: Richard A. Baglione, 2220 Park Ave., #15, Santa Clara, Calif. 95050

[21] Appl. No.: 456,583

[22] Filed: Jan. 7, 1983

Related U.S. Application Data

[63] Continuation of Ser. No. 228,590, Jan. 26, 1981, abandoned.

[51] Int. Cl.[3] ..... F25B 41/00

[52] U.S. Cl. ..... 62/209; 62/228.3

[58] Field of Search ..... 62/127, 126, 209, 212, 62/228.3

[56] References Cited

U.S. PATENT DOCUMENTS

| | | | |
|---|---|---|---|
| 3,913,347 | 10/1975 | Stevens | 62/209 |
| 4,167,858 | 9/1979 | Kojima | 62/126 |
| 4,245,480 | 1/1981 | Saunders | 62/292 |

*Primary Examiner*—William E. Wayner

*Attorney, Agent, or Firm*—John J. Leavitt

[57] ABSTRACT

Presented is a control device which may be added to an already existing air conditioning refrigeration system, or which may be built into the air conditioning refrigeration system at the factory and which monitors the temperature and pressure of a refrigerant flowing in the refrigeration system to determine increases or decreases in the ratio of pressure change to temperature change above or below a predetermined and desirable super-heat temperature for the particular system involved. The increase or decrease of this super-heat beyond predetermined upper and lower limits deactivates the refrigeration system so as to prevent damage thereto.

11 Claims, 13 Drawing Figures

TO FIG. 5
6 6
9
D1
D2
9'
D1'
D2'

(ALTERNATE)
+20VDC
-20VDC
8
R7
A1
TR
R6
R4
R3
R5
VR1
VR2
R11
C1
R12
C2
4
B1
B2
T1
T2
+20 VDC
5
BRIDGE CIRCUIT
2
3

SUPER-HEAT MONITORING AND CONTROL DEVICE FOR AIR CONDITIONING REFRIGERATION SYSTEMS

This is a continuation of application Ser. No. 228,590, filed Jan. 26, 1981.

BACKGROUND OF THE INVENTION

1. Field of the Invention

This invention relates to control devices for air conditioning refrigeration systems and particularly to a device that monitors the super-heat contained in a refrigerant to control operation of the compressor if the super-heat contained in the refrigerant either exceeds or falls below predetermined limits.

2. Description of Prior Art

It is believed that the prior art related to this invention may be found in Class 62, sub-classes 149, 158, 208, 209, 227 and 228. A search through the class and sub-classes indicated has revealed the existence of U.S. Pat. Nos. 3,913,347; 3,047,696; 3,400,552; 3,729,949; 3,303,663; 3,803,864; 3,786,650; 3,130,558; and 3,791,165.

In refrigeration systems there is a so called "suction line" which runs from the evaporator to the compressor. This line normally returns the heat-laden refrigerant in gaseous form from the evaporator to the compressor. The line is so arranged that the refrigerant gas is warmed a few degrees as it picks up heat through the walls of the tubing. Heat may be applied to the tubing in various ways, such as by running the suction line through a heat exchanger so as to draw heat from the high pressure and relatively "hot" liquid refrigerant prior to its presentation to the expansion valve in the system. This method achieves the double function of adding "super-heat" to the refrigerant gas returning through the suction line to the compressor, and "sub cooling" the high pressure relatively "hot" liquid refrigerant prior to passage through the expansion valve. Super-heat may thus be defined as the heat contained in a refrigerant gas beyond the amount required to maintain its boiling point. Since super-heat causes a rise in temperature of the refrigerant gas in its return to the compressor, it is sensible heat. The fact that super-heat can be sensed or detected by the "sensing element" of an instrument is relied upon in U.S. Pat. No. 3,047,696 in which it is recognized that the thermostatic expansion valve which releases high pressure liquid refrigerant in a controlled manner into the relatively low pressure space provided by the evaporator normally controls the super-heat of the refrigerant leaving the evaporator. The super-heat control device disclosed by this patent is related to the control of the air conditioning system of an automobile, and teaches that with the particular refrigerant disclosed by this patent the normal level of super-heat in the suction line is approximately 23° F. The patent discloses that when the super-heat exceeds about 60° F., this is an indication that the refrigerant charge has been lost in the system. Accordingly, under normal conditions, such a loss of refrigerant can cause extensive damage to the compressor if the compressor is not shut down. According to the invention disclosed by this patent, when the exceedingly high super-heat is detected, an electrical circuit is closed which has the effect of blowing a fuse which results in deactivating the compressor unit. To close the electrical circuit, this patent discloses a device that utilizes differential pressure between suction line refrigerant and a second refrigerant which is responsive to the increase in temperature of the suction line refrigerant gas to shift the position of a diaphram carrying an electrical contact.

U.S. Pat. No. 3,130,558 recognizes the destructive effect of a slug of liquid refrigerant admitted to the input port of the compressor. Since most liquids, including liquid refrigerants, are not compressible, and since a compressor is intended to be a vapor pump dependent for its operation upon the elasticity of the vapor it is compressing, the admission of an incompressible slug of liquid refrigerant to the input port of the compressor will obviously result in damage to the compressor. This patent teaches a system for protecting the compressor from such a slug of liquid refrigerant which involves sensing the temperature of the refrigerant in the suction line and applying this temperature to the expansion valve in such a way that liquid refrigerant is normally admitted to the evaporator under controlled conditions that insure that the temperature of the refrigerant leaving the evaporator contains the requisite amount of super-heat.

This interrelationship of temperature of the refrigerant gas as it leaves the evaporator, and control of the expansion valve in relation thereto, is almost universally used in air conditioning refrigeration systems. This patent goes one step further and includes in the suction line a control device including a diaphram enclosed within a housing. Movement of the diaphram in one direction effects closing of electrical contacts which activate a solenoid valve arranged in a bypass line to permit the passage of high pressure and relatively "hot" refrigerant gas to be admitted to the suction line, thereby adding "super-heat" to the refrigerant gas returning to the compressor and eliminating the possibility of a slug of liquid refrigerant damaging the compressor. Movement of the switch-controlling diaphram in one direction is influenced by the pressure within the suction line, as balanced by an appropriate spring, and movement in the opposite direction is influenced by the expansion of an appropriate second refrigerant in the space above the diaphram, expansion of the second refrigerant being controlled by the temperature of the refrigerant gas returning through the suction line to the compressor.

U.S. Pat. Nos. 3,303,663 and 3,400,552 both relate to apparatuses for controlling the charging of a refrigerant into an operating refrigeration system. Both utilize the pressure and temperature characteristics of the returning suction line refrigerant gas for control purposes.

U.S. Pat. No. 3,686,892 teaches the concept of utilizing the temperature of the refrigerant gas returning to the compressor to actuate a switch which in turn energizes a wire heater which in turn opens a thermally responsive fuse to de-energize the compressor circuit.

U.S. Pat. No. 3,729,949 relates to the use of a plurality of movable switch elements that are responsive to temperature and pressure to control the charging of a refrigeration system with an additional charge of refrigerant.

U.S. Pat. No. 3,786,650 relates to an air conditioning control system in which the expansion valve is controlled in such a manner as to permit maximum cooling capacity of the refrigeration system upon start-up, particularly when the space being cooled is particularly warm, such as the inside of an automobile that has been in the sun. When a reduced ambient temperature is attained, or when a reduced suction line temperature is attained, the expansion valve is automatically re-set to its normal operating parameters.

U.S. Pat. No. 3,791,165 also relates to a charging method and apparatus for a refrigeration system and is specifically applicable to a refrigeration system having a fixed restriction refrigerant expansion valve. Proper operation of such a refrigeration system is achieved by adding or removing refrigerant to the system to attain a preselected super-heat temperature of the refrigerant leaving the evaporator coil as determined by comparing the pressure and temperature of such refrigerant gas.

U.S. Pat. No. 3,803,863 relates to a system for controlling a refrigeration compressor which involves monitoring the super-heat contained in the refrigerant gas returning to the compressor, monitoring the temperature of the space to be cooled as compared with a set point, generating separate electrical signals correlated to the super-heat temperature and the differential between the set point and the space temperature, and utilizing these signals to produce a modulating signal for regulating the compressor operation in the refrigeration system.

U.S. Pat. No. 3,803,864 also relates to an air conditioning control system which utilizes a normally constant pressure expansion device for admitting liquid refrigerant to the evaporator but which is adapted to adjust the expansion device to maintain a relatively high evaporator pressure during the time that the temperature in the space to be cooled is being reduced to its desired level. When the space temperature has reached the desired level, the expansion device then reverts to its normal operation.

U.S. Pat. No. 3,803,865 utilizes two vacuum control valves, one in the feed line between the condensor and the evaporator and another in the suction line between the evaporator and the compressor. The vacuum port of the first mentioned valve is connected to the suction line while the suction port of the second valve is connected through appropriate conduit to the induction system of an automotive engine. Application of suction to the second valve results in a pneumatic signal being transmitted to the first valve to increase the control point at which the evaporator pressure is controlled.

Lastly, U.S. Pat. No. 3,913,347 relates to a mechanically operated switching arrangement controlled by pressure of refrigerant in the suction line on the one hand, and by pressure as it is related to the temperature of the refrigerant gas in the suction line on the other hand. Pressure responsive bellows are opposed to each other and each is in contact with a lever pivoted in such a manner to open or close or neutralize a pair of contacts, depending upon the differential in pressure as exerted directly by the pressure of the suction line and the pressure exerted by heating an appropriate refrigerant by means of the heat contained in the refrigerant gas.

From the above prior art it will be apparent that there have been many different mechanical devices utilized that respond directly to variations of pressure of the refrigerant gas in the suction line, and which respond to variations in pressure in an auxiliary bulb containing an appropriate refrigerant gas and responsive to temperature variations of the refrigerant gas in the suction line. Most of these devices, as indicated in the patents discussed above, are mechanical devices with the disadvantages inherent in such mechanical device, such as slow response time, different characteristics because of inability to maintain manufacturing tolerances, and space limitations that preclude many of these cumbersome mechanical devices to be retro-fitted to existing equipment. Accordingly, it is one of the principal objects of the present invention to provide a control device for air conditioning refrigeration systems that is almost instantaneous in its response time and which may be easily retro-fitted to existing air conditioning refrigeration systems.

In the operation of an air conditioning refrigeration system it frequently happens that the super-heat in the suction line will fluctuate through a relatively wide range in a very short period of time. Such fluctuations occur in most refrigeration systems and are usually not harmful because their duration is a relatively short period of time. With the mechanical structures disclosed in the patents above, such fluctuations would have their normal and expected effect on the mechanical transducers connected to the sensors and, because of the inherent lag time in the mechanical devices, the system might be shut down despite the fact that the super-heat fluctuation no longer exists and the super-heat is approaching a normal value. Accordingly, another object of the invention is to provide a control device for air conditioning refrigeration systems which is responsive to such extreme fluctuations of super-heat within a prescribed range and which is effective to delay the effect of such fluctuations so as to preclude shutting down the refrigeration system unnecessarily.

It is particularly surprising that it is not revealed in any of the patents disclosed above or in operation manuals and texts on refrigeration that there is a substantially linear relationship between the suction line pressure and the temperature of the refrigerant gas flowing through the suction line. I have found that when this relationship is defined as a ratio of change of the pressure in the suction line to a change of temperature of the refrigerant gas passing therethrough, as long as the ratio is maintained, the super-heat in the refrigerant gas returning to the compressor may vary over a relatively wide range without the need to activate protective devices. Accordingly, a still further object of this invention is to provide a control device in which a predetermined super-heat temperature may be selected as the optimum super-heat for a given system, and the device set to initiate remedial steps only if the super-heat either drops a significant predetermined amount below such set super-heat temperature or rises a significant predetermined amount above the preset super-heat temperature, and to not initiate remedial steps so long as the ratio of change of pressure and temperature remains constant within the preselected range.

It frequently happens that an abnormality in the operation of a refrigeration system will cause either a loss or a gain of the super-heat in the refrigerant gas returning to the compressor. Frequently the malfunction that causes the loss or gain in super-heat cures itself within a short interval. It is a disadvantage to have the system shut down because of a temporary abnormality in the operation of the system. Accordingly, still another object of the present invention is to provide a control device that initiates a counter which locks out other protective devices for a predetermined interval to thus permit the system a sufficient time to return to its normal mode of operation without shutting down the system.

The invention possesses other objects and features of value, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the super-heat monitoring and control device for air conditioning refrigeration systems of the invention comprises separate temperature and pressure monitoring sensors the signals from which are converted to electrical signals applied to a bridge circuit including a set-point adjustment and a throttling range adjustment which may be manipulated to set the ideal or desired super-heat temperature and the range of such temperatures, respectively. The bridge circuit also possesses a ratio adjustment that permits calibration of the bridge to the particular sensors being used, to thus set up the optimum pressure/-temperature ratio. The output from the bridge circuit is channelled to a preamplifier, and the output from the preamplifier is in turn channelled to an integrator that includes a control function comprising an adjustable timer which may be adjusted to a time interval that corresponds to the time interval that the system in question requires to reach its normal super-heat condition. From the integrator circuit, the signal is channelled to a pair of comparator circuits which control a lockout relay which in turn controls the compressor circuit of the refrigeration system, to shut down the system if the super-heat level remains at too high or low a value for too long an interval.

DESCRIPTION OF THE PREFERRED EMBODIMENT

Figure 1:
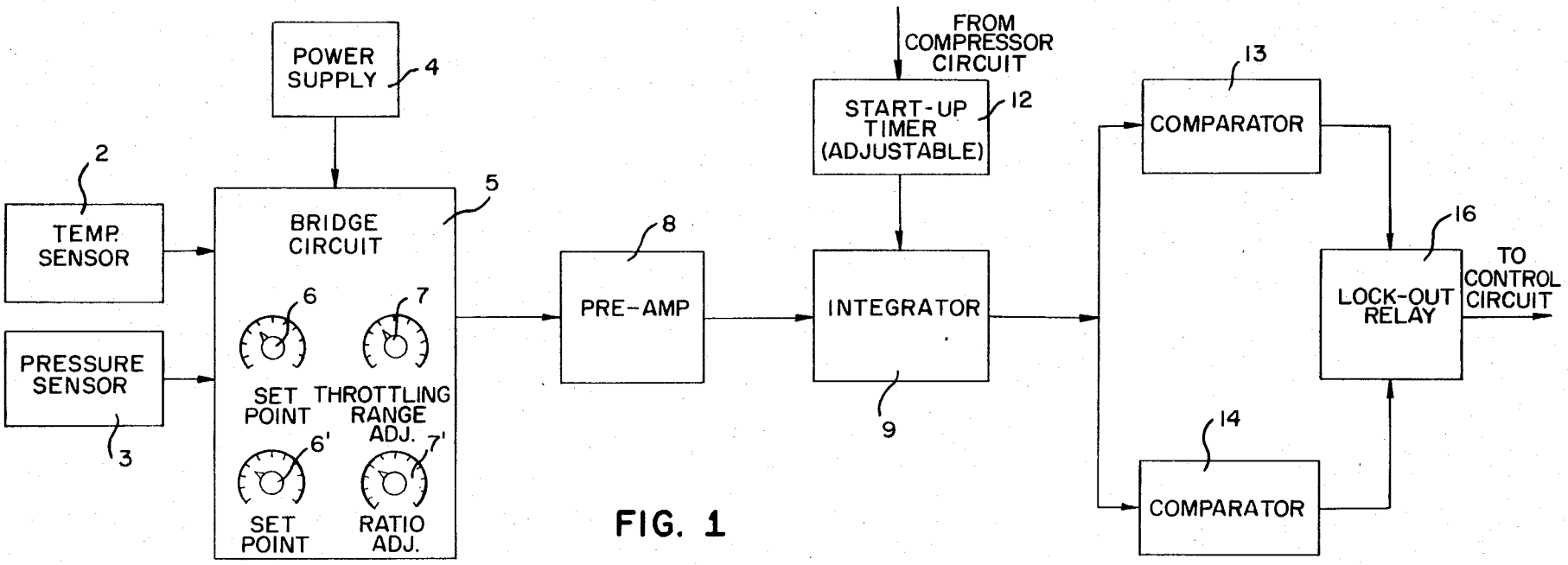
FIG. 1 is a block diagram illustrating the various components of the super-heat monitoring and control device of the invention.

In terms of greater detail, the super-heat monitoring and control device for air conditioning refrigeration systems which forms the subject matter of this invention, comprises a system or device that functions to control the operation of a refrigeration system in relation to whether the super-heat exceeds or falls below upper and lower limits that are selected for the particular refrigeration system in question. It is a matter of common knowledge that the reciprocating compressor, usually driven by an electric motor, is the heart of most air conditioning refrigeration systems. The compressor is a mechanical unit that is highly susceptible to damage as a result of abuse. Most compressor failures are not the fault of the compressor per se, but rather the fault of some other component in the system in which the compressor is used.

For instance, hermetic compressors usually fail in one of two ways, i.e., mechanically or electrically. Electrical failures may stem from power line or control problems, but oftentimes it is simply the overheating of the compressor that initiates the electrical failure. Mechanical failures may be caused by inherent defects, but more often than not they are caused by the presence of liquid refrigerant in the compressor. It is of course well known that refrigerant vapor is utilized to cool the compressor into which it is sucked at low pressure. If the refrigerant vapor is saturated, however, then there is usually a finite amount of liquid refrigerant that passes into the compressor, with attendant damage to the compressor valves, requiring an expensive shut-down and overhaul of the compressor.

Thus it is imperative for proper operation of the compressor that the low pressure gaseous refrigerant sucked into the compressor not be saturated, i.e., that it be completely gaseous. This condition is most usually ensured by controlling super-heat in the refrigerant gas in the evaporator and suction line before it reaches the compressor. The presence or absence of super-heat in the refrigerant gas in the evaporator and moving toward the compressor through the suction line is closely controlled under ordinary circumstances by the thermostatic expansion valve. This valve closely controls the amount of liquid refrigerant that is admitted to the evaporator by monitoring the temperature of the refrigerant gas leaving the evaporator. If the temperature monitored is greater than the boiling temperature of the particular refrigerant, then it can be assumed that all the liquid refrigerant admitted to the evaporator has evaporated. Thus, it is the differential in temperature between the temperature sensed at the outlet port of the evaporator and the boiling temperature of the refrigerant that controls the amount of liquid refrigerant admitted to the evaporator by the thermostatic metering expansion valve. This differential temperature, when greater than the boiling temperature, constitutes super-heat in the refrigerant gas.

It thus becomes apparent that the thermostatic metering expansion valve is a "watch dog" that controls the rate of evaporation of liquid refrigerant in the evaporator, and that the rate of evaporation ultimately determines the degree of super-heat contained in the refrigerant gas leaving the evaporator. The measure of super-heat in the refrigerant gas leaving the evaporator, and the super-heat if any, added to it during its passage through the suction tube, determines in large measure the effectiveness of the refrigerant gas to cool the compressor. If the super-heat becomes too high, the refrigerant loses its cooling effect and the compressor runs too hot. If the super-heat becomes too low or non-existent, it indicates that there is saturated vapor and/or liquid refrigerant in the suction line which if permitted to enter the compressor may result in extensive damage.

As indicated above, there are devices that protect the compressor from overheating, and there are devices that protect the compressor, indirectly, from the effects of liquid refrigerant. Surprisingly, however, nowhere have I been able to find a device or control system that will protect the compressor against adverse super-heat conditions, high or low. I have found that such protection can be provided by closely monitoring the pressure and temperature relationship of the refrigerant gas which indicates the amount of super-heat present, and controlling operation of the compressor in relation to fluctuations thereof.

I have found that there are basically four steps in setting up this control or monitoring device on an air conditioning refrigeration system. The first step is to measure and note the operating super-heat of the system on which the control and monitoring device is to be installed. Secondly, it is important to determine and note how long from start-up it takes the equipment in question to reach this stable super-heat value. These measurements are made with conventional equipment that is available to all refrigeration or air conditioning technicians or servicemen. Once these determinations have been made the start-up delay timer is set. It is important to set this timer because almost all systems experience momentary fluctuations of super-heat from start-up to about five minutes after start-up, and it is not desirable that the system be shut down because of these normal momentary fluctuations. The delay timer thus enables the system to accommodate the individual start-up characteristics of most systems. During this observation interval of a normally functioning refrigeration system, it is important to note the normal fluctuations of super-heat. The range of fluctuations of super-heat from high to low thus suggests the throttling range adjustment of the control device of this invention, shutting down the system if the fluctuations exceed the high or low values of the range for longer than a predetermined interval. Also important is that the set-point of the device be set to the measured super-heat of the system during normal operation.

Once the set-point and throttling range are established in the device, the lockout timing becomes a function of the amount that the throttling range is exceeded, on either end, i.e., high or low, by the super-heat and the time interval that it continues outside the throttling range. If the super-heat falls back within the acceptable range before the lockout relay is energized, the timer will reset itself, and will not become reactivated unless the throttling range is exceeded again. If the system is locked out by activation of the lockout relay, it can only be reset manually. This is usually provided for in most conventional systems by the provision of a reset relay. For the incorporation of my control and monitoring device, if a refrigeration system does not have a reset relay, one should be insfalled as will hereinafter be explained, at the time the control and monitoring device of this invention is installed.

The monitoring and control device of this invention can be used on almost every air conditioning system utilizing a thermostatic metering expansion valve. In the detailed description that follows, the parameters have been selected for use with Refrigerant 22 systems. It should be apparent however that the device can be easily changed to accomodate most of the commonly used refrigerants in reciprocating type systems, e.g. R-12, R-500 and R-502.

Figures 4, 6:
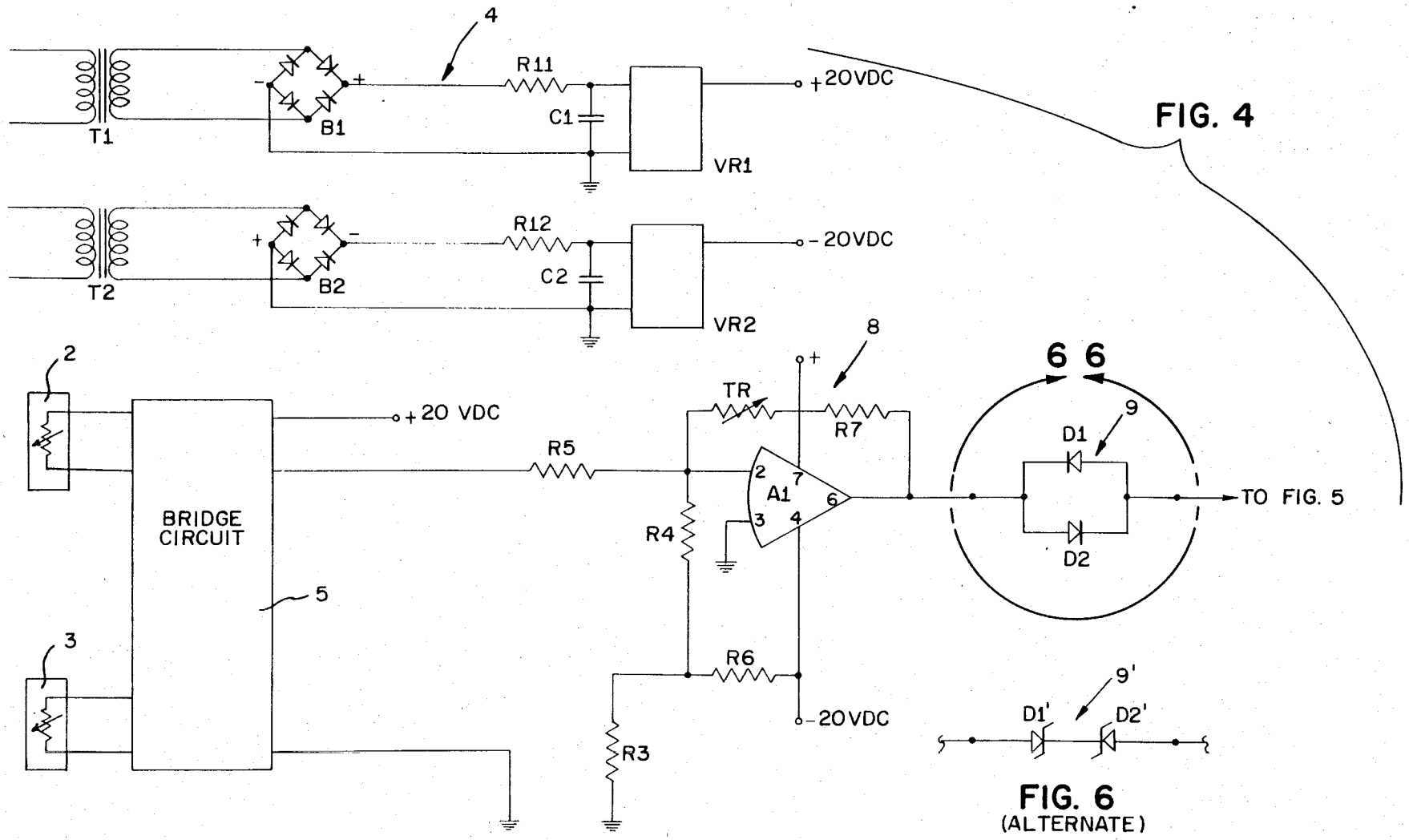
FIG. 4 is a diagrammatic view illustrating a portion of the entire control device circuit, including electronic and electrical components and their values and identifications.
FIG. 6 is an alternate arrangement for a portion of the circuit as illustrated in FIG. 4 by the line 6—6.
Figure 5:
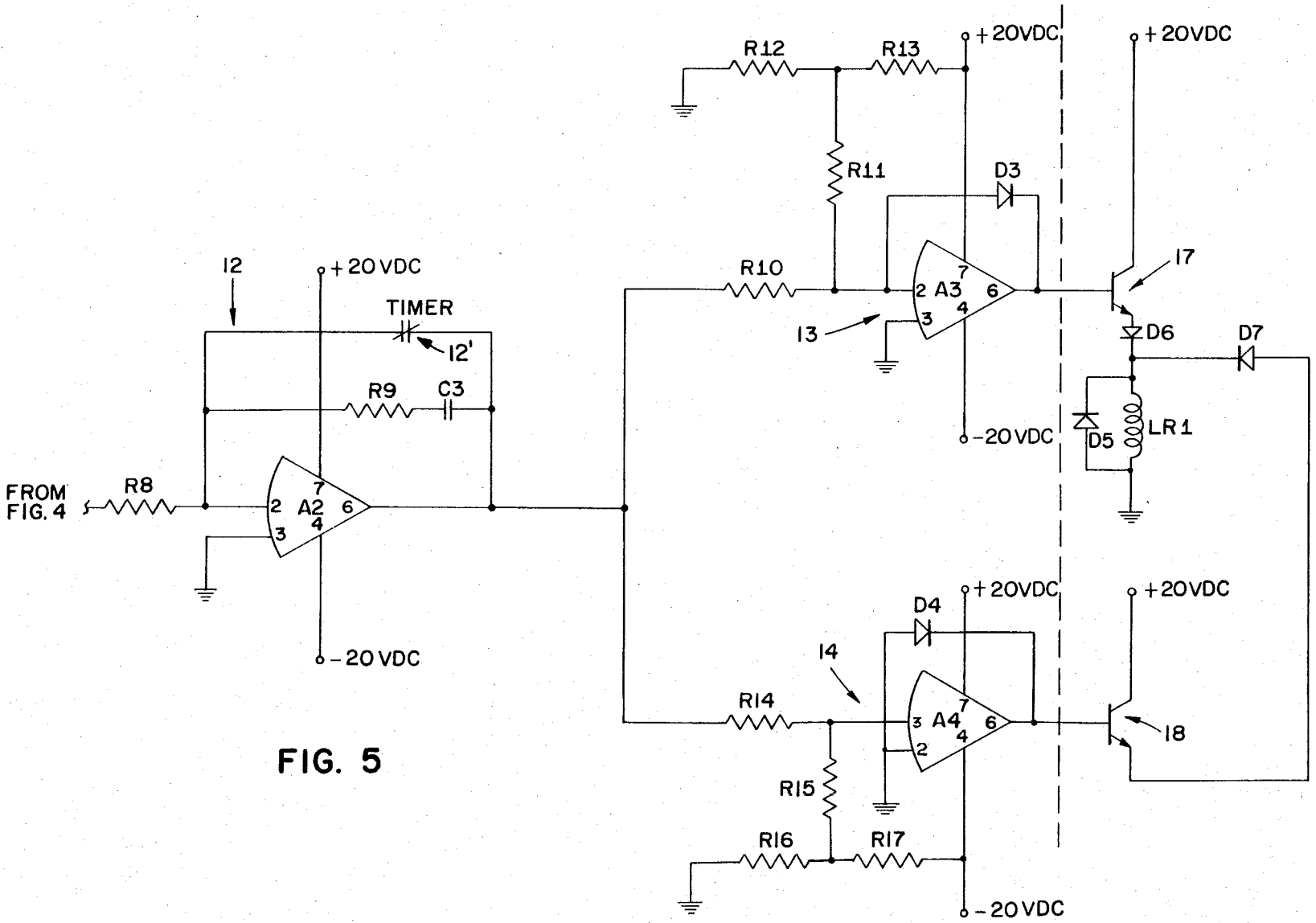
FIG. 5 is a diagrammatic view constituting a continuation of the circuit illustrated in FIG. 4.
Figure 7:
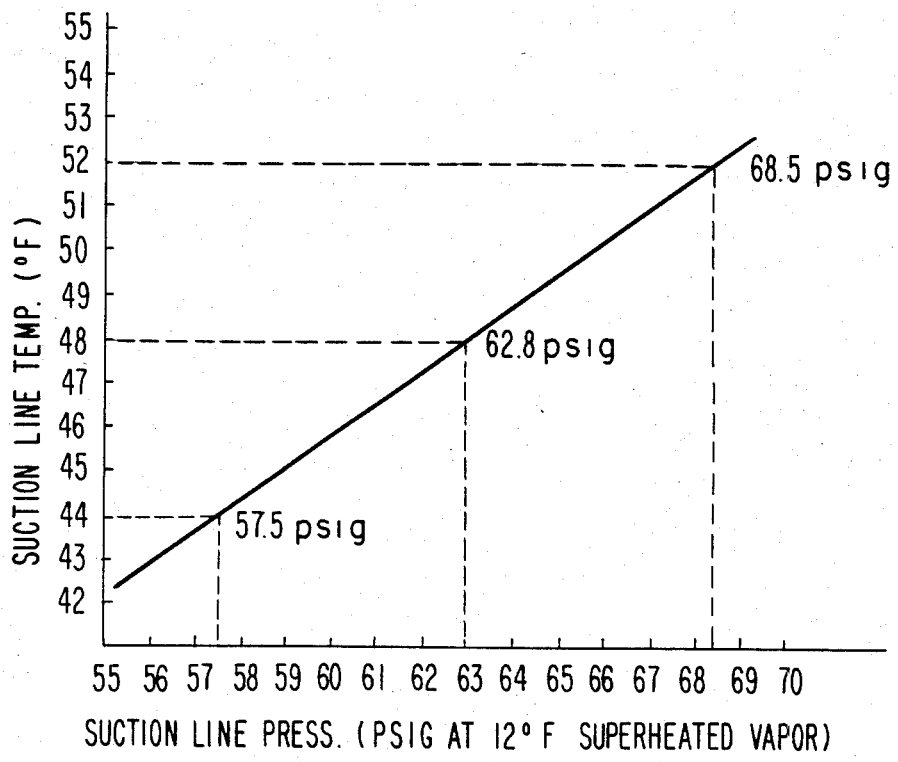
FIGS. 7–11 are graphical illustrations of the pressure and temperature relationships in the system of the invention.
Figure 8:
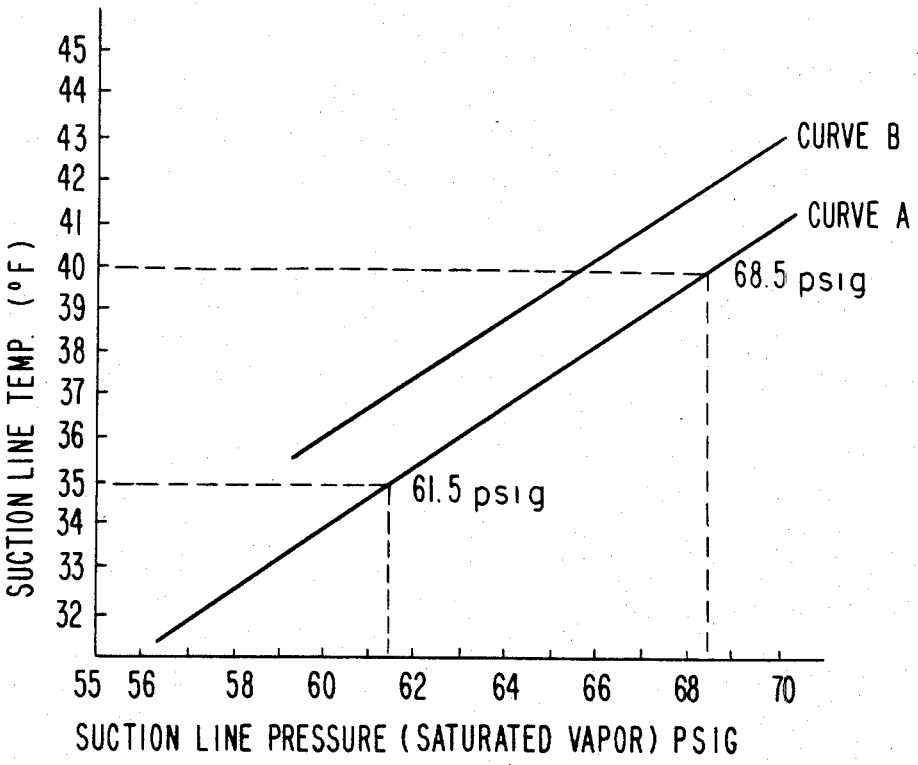

The circuit illustrated in FIGS. 4 and 5 is designed on the premise that a constant value of super-heat is correlated to a direct substantially linear proportional relationship between suction line gas pressure and suction line gas temperature. This being true, an increase in suction line gas pressure is manifested by a proportional increase in suction line gas temperature. FIGS. 7 and 8 exemplify these relationships. In FIG. 7, suction line gas pressures in pounds per square inch gauge for a gas containing 12° F. of super-heat are plotted against suction line gas temperatures. It is seen that the resulting "curve" is substantially a straight line. Calculations indicate that for Refrigerant 22 and a constant 12° F. super-heat the proportional change in pressure is an average of 1.31 psi per degree change in temperature. Thus, over a super-heated vapor pressure spread of 11 psi (68.5−57.5) there occurs a temperature spread of 8° F. (52°−44°), producing an overall ratio of 1.37 psi/°F. The same calculations made at the 62.8 psi level in relation to the 57.5 psi level and corresponding temperature spread (4° F.) produces a 1.32 psi/°F. ratio, while the 57.5 psi level and 55 psi level produce a 2.5 psi variation which results in a 1.25 psi/°F. ratio when divided by the temperature differential of 2° F. The average of these ratios is 1.31 psi/°F. as indicated in FIG. 7.

In FIG. 8, the substantially linear and proportional change of the pressure-temperature relationship is illustrated by plotting temperature against pressure of a saturated vapor (without super-heat) on a single graph again showing the linearity of the "curve A" between lowest and highest values. Superimposed on "curve" is "curve" B which represents the addition of 2° of super-heat to the boiling point temperatures plotted as ordinates in FIG. 8.

Figure 9:
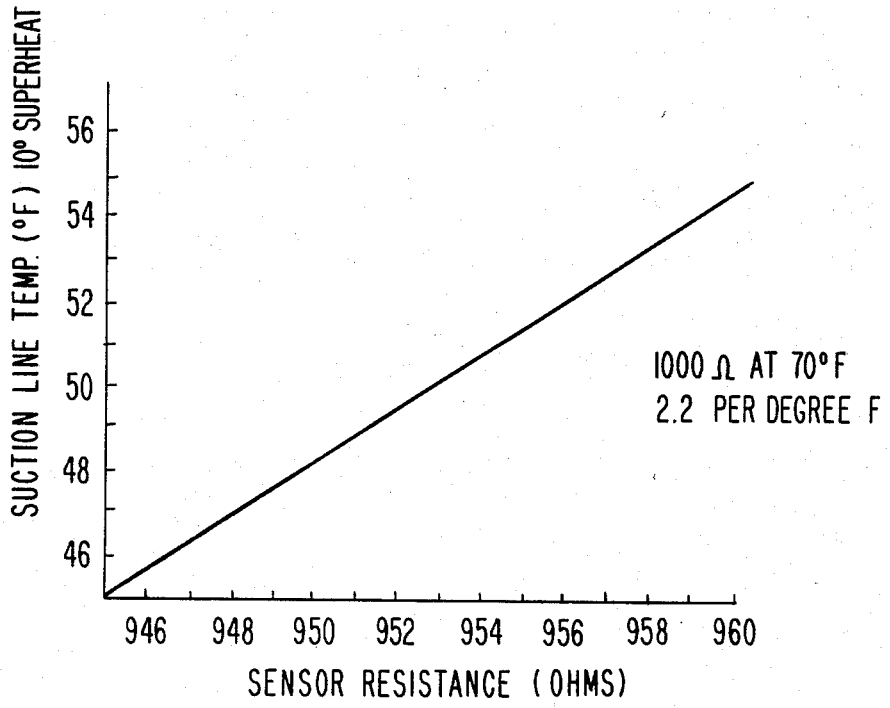
Figure 10:
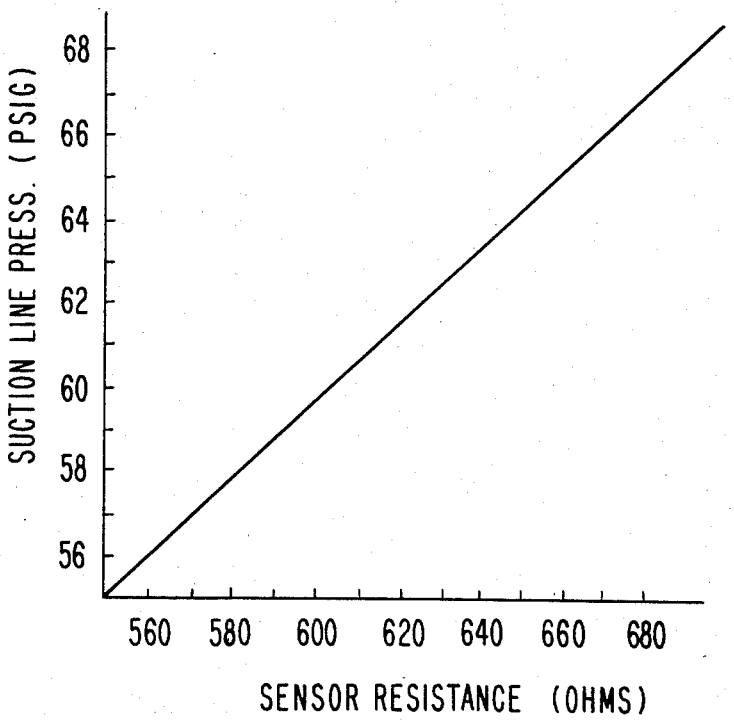

The significance of these linear relationships is illustrated in FIGS. 9 and 10. In FIG. 9, actual suction line gas temperatures sensed are plotted as ordinate values against measured electrical resistance in ohms plotted as abscissa values. Note the substantially linear relationship that results. The slope of this "curve" is based on the fact that the particular sensor used is calibrated to provide 1000 ohms electrical resistance at 70° F., and a 2.2 ohm change per degree change in temperature. In FIG. 10, actual suction line gas pressures sensed are plotted as ordinate values against measured electrical resistance in ohms plotted as abscissa values. Again a linear relationship is manifested by the slope of the line that results. The slope of this "curve" is based on the fact that the particular sensor used is calibrated to provide 1000 ohms electrical resistance at 100 psig, thus resulting in a 10 ohm change in resistance per pound change in gauge pressure. The difference in slope of these two curves (FIGS. 9 and 10) is accounted for by the fact that the rate of change of resistance caused by variations in pressure (10Ω per pound per square inch gauge) is greater than the rate of change of resistance resulting from a change of temperature (2.2Ω/°F.) by a factor of approximately 6.36 to achieve a pressure/temperature ratio of 1.4 psig/°F., and by a factor of approximately 5.91 to achieve a pressure/temperature ratio of 1.3 psig/°F. It is this factor that must be considered when calibrating the bridge to provide a balanced output at a 12° F. super-heat and a pressure/temperature ratio of 1.3 psig/°F.

From FIGS. 9 and 10 it may thus be concluded that since the change in electrical resistance is linear in response to similarly linear changes in suction line gas temperature and pressure for a constant super-heat value, then such linear electrical resistance increases and decreases may be applied to a bridge circuit as will hereinafter be explained, with the result that the resistance changes will be balanced out by the bridge circuit so long as the super-heat remains constant (e.g. at 12° F.) When an abnormal condition occurs, e.g., an overcharge, undercharge, expansion valve malfunction, clogged or dirty filters, broken evaporator fan belt, defective fan motor, or any other of numerous types of failures, the operating super-heat will increase or decrease abnormally, indicating that the pressure has risen or fallen at a faster or slower rate than normal, as opposed to temperature, thus changing the 1.3 psig/° F. ratio set in the bridge circuit. When the super-heat value, either high or low, exceeds the high or low limits set by the throttling range for a predetermined interval, the lock out relay will be energized and the system will be shut down.

Figure 11:
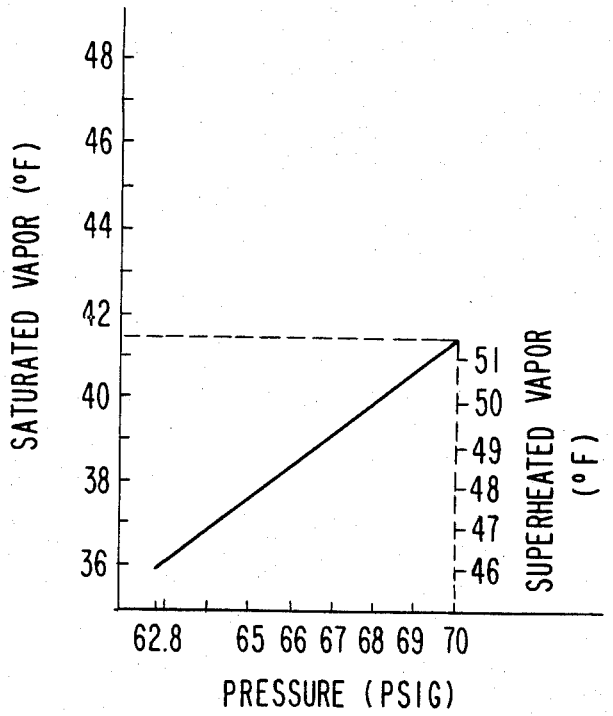
Figure 12:
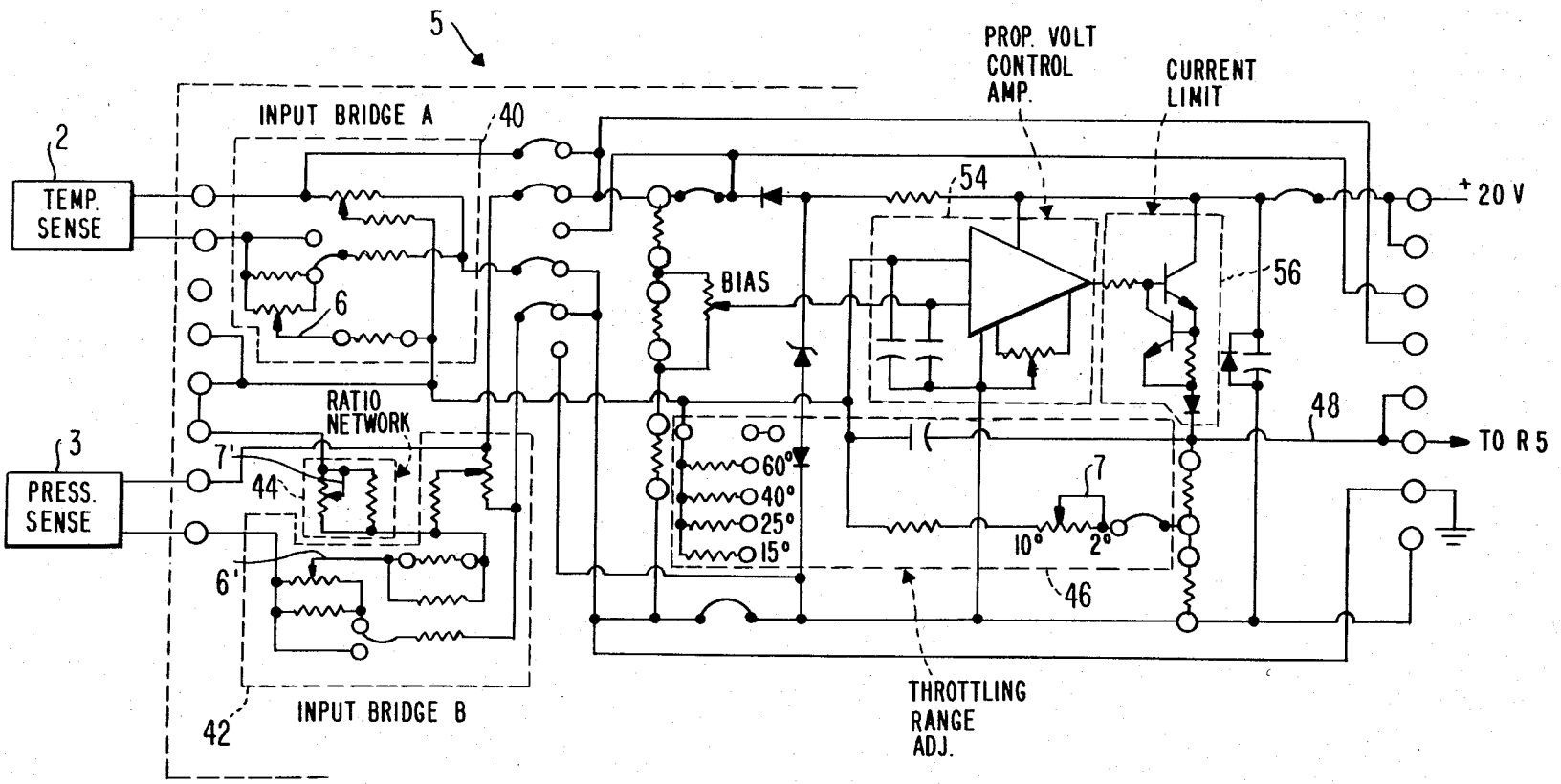
FIG. 12 is a schematic diagram of a bridge circuit usuable with the system of the invention.

Referring to the drawings, the entire device in block diagram form is illustrated in FIG. 1, where reference numeral 2 designates a temperature sensor of the thermistor type in which the resistance of the thermistor varies directly with temperature change. I have found that a thermistor having a resistance value of 1000 ohms at 70° F. and a rate of change of 2.2 ohms per degree F. is satisfactory. A pressure sensor 3 is also provided. This unit may be a commercially available type that responds to pressure variations to effect movement of a wiper blade across an elongated resistor. Its rate of change may be 10 ohms per pound per square inch of pressure change and its range is from zero to 100 psig. Because the operating parameters of the temperature and pressure sensors are usually fixed for specific units, the ohmic rate of change being different for the temperature and pressure sensors, the ratio of change must be set in the bridge circuit, as previously discussed. This ratio adjustment is exemplified by FIG. 11 in which the temperatures of both super-heated vapor and saturated vapor are plotted as ordinate values against pressure values plotted as abscissa values. From the graph of FIG. 11 it will be seen that for a pressure rise of 7.2 psig from 62.8 psig to 70, there is a corresponding 5.5° F. rise in temperature from 36° F. (saturated vapor) to 41.5. The ratio of 7.2 to 5.5 thus equals approximately 1.4 psig change for each degree change in temperature. Correlated to pressure and temperature sensors that vary electrical resistance as indicated above (10Ω/lb. and 2.2Ω/° F.) it will be seen that 1.4 psig translates the 14 ohms which, when divided by 2.2 ohms, provides a balancing ratio adjustment factor of 6.36 which is dialed into the bridge circuit to compensate for the different rates of the pressure and temperature sensors. Thus, a Barber-Coleman Model CP8102 bridge; illustrated in FIG. 12, provides adjustment bridge 40 for setting the temperature set point, another adjustment bridge 42 for setting the pressure set point, a third adjustment network 44 for selecting the balancing ratio adjustment factor, and an adjustment network 46 for setting the throttling range as previously discussed.

Receiving power from a standard 120 VAC source is a power supply 4 (FIG. 4) which is designed to provide a regulated output of +20 VDC and −20 VDC, which is fed into bridge circuit 5, which also receives inputs from the two sensors 2 and 3. The bridge circuit may be purchased commercially from Barber-Colman Company in several different models to meet different needs. For instance, I have found that Model CP8102 having the adjustability flexibility noted above provides satisfactory results. The bridge circuit is provided with potentiometric set point adjustment knobs 6 and 6', a ratio adjustment knob 7' and a throttling range adjustment knob 7 as shown in FIG. 1, and by their counterpart potentiometer adjustment arms in FIG. 12. The set point adjustment knobs 6 and 6' are utilized to set the desired super-heat for the system in which the control device of the invention is being installed, while the throttling range adjustment is used to set the high and low points or limits of the super-heat for the system in question. When the bridge circuit is properly calibrated and adjusted for the system in question under normal operating pressure and temperature, its output voltage on output line 48 will be 7.5 VDC when the two inputs from the temperature and pressure sensors are balanced. The point at which the bridge circuit will be balanced is determined by setting the ratio adjustment knob 7'. The throttling range adjustment is determined by amplifier response to variations in output from the bridge circuit. Total resistances of each side of the bridge must change at a constant rate to keep the system in balance.

The control device includes a preamplifier 8 that amplifies the output of the bridge circuit and channels the signal to the integrator 9. The output of the preamplifier is adjusted so that when the bridge output is 7.5 volts, the amplifier output is 0 volts. Any change in bridge output then produces an offset voltage which is supplied to the integrator 9, so that the output of the integrator is a function of the input offset voltage and offset duration. "Offset voltage" is any voltage greater or less than zero volts DC. The output from the integrator may vary from −20 VDC to +20 VDC, with zero volts being at the balance point of the bridge, i.e., when the bridge circuit is balanced and its output is 7.5 VDC. The integrator 9 as illustrated in FIG. 4 is designed to provide a "dead band" or interval in which the voltage to the preamplifier 8 may swing ±2 volts above or below the 7.5 volt balanced output from the bridge circuit 5, to provide a voltage spread or "dead band" from 5.5 to 9.5 volts, thus accommodating momentary fluctuations and precluding unnecessary triggering of the integrator. If additional "dead band" is needed for a given application, the alternate arrangement for an integrator shown at 9' in FIG. 6 may be substituted.

Associated with the integrator 9 in the control device is a start-up timer 12 which is a solid state, adjustable timer which disables the integrator during start-up by opening its associated normally-closed contact 12'. This permits the system parameters to fluctuate for whatever time is set in the start-up timer so that the system will not be shut down by such fluctuations, which are usually of short duration. When the start-up timer 12 times out, its contact 12' (FIG. 5) closes, permitting the output from the integrator to be channeled to comparator circuits 13 and 14 which are effective, upon appropriate circumstances, to energize the lock-out relay 16. Energization of the lock-out relay 16 is effected through two current amplifiers 17 and 18 (see FIG. 5). The two comparator circuits energize the lock-out relay 16 when their input voltages reach preset levels, e.g., +10 VDC or −10 VDC. One comparator circuit is set to trip at +10 VDC, and the other comparator circuit is set to trip at −10 VDC. If either comparator circuit trips, it will allow a +20 VDC signal to energize the lock-out relay 16 through current amplifiers 17 and 18.

Figure 2:
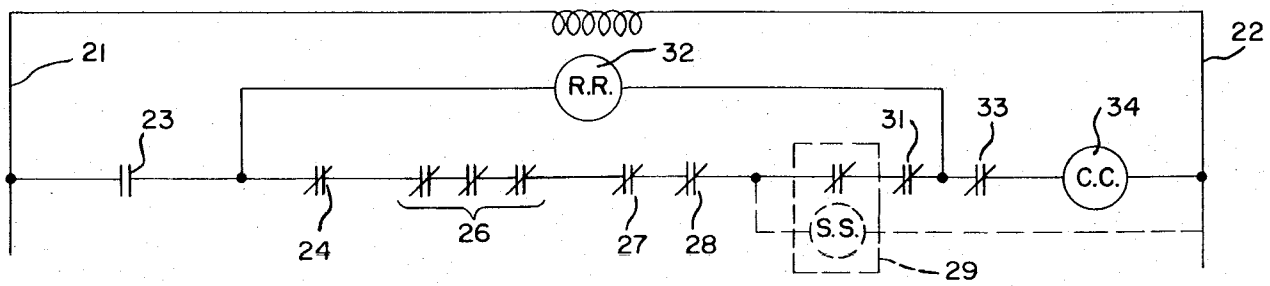
FIG. 2 is a diagrammatic illustration showing the manner of incorporation of the device of this invention in an air conditioning refrigeration system assembled at the factory.

FIG. 2 illustrates schematically a typical installation of the control and monitoring device of this invention in a system containing a reset or lock-out relay. Line voltage is applied as indicated to the two terminal leads 21 and 22, between which are connected various types of protective devices such as the control relay 23, a high pressure safety relay 24, external motor overload relays 26, a solid state motor protector 27, and an oil failure switch 28. The control device of this invention is tapped into the system circuit as shown in broken lines and designated by the numeral 29, ahead of the reset relay contact points 31 which are activated or controlled by the reset relay solenoid coil 32. My control device is also tapped into the system circuit ahead of the low pressure safety switch 33 and the compressor contactor 34 as shown.

Figure 3:
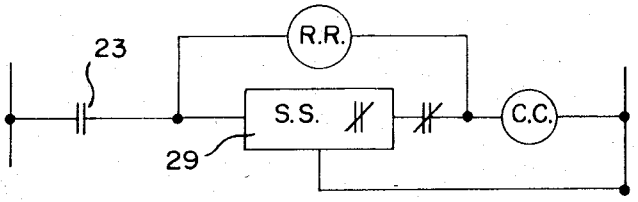
FIG. 3 is a diagrammatic view illustrating the manner of retrofitting the device of this invention in an already existing system.

There are of course many systems which do not incorporate the safety features discussed in the previous paragraph, and particularly do not utilize a reset relay with appropriate contact points so that the system can be reset once it has been tripped off by the control relay 23. These systems provide a compressor contactor 34, and before the control and monitoring device of this invention is installed, the system should be provided with the reset relay solenoid 32' and the reset relay contacts 31' as shown in FIG. 3.

Referring to FIGS. 4 and 5 wherein the detailed circuitry of the device is illustrated, I have found that components having the following values, when connected as shown, provide satisfactory monitoring and control functions.

| | |
|---|---|
| T1 and T2 | Step-down transformers 120 or 240 VAC/36 VAC at 200 ma. |
| B1 and B2 | Full Wave Bridge Module 200 PRV at 500 ma. |
| VR1 and VR2 | Lambda or equivalent voltage regulators |
| TR | 100K, ½ Watt linear taper potentiometer |
| Timer | SPDT time delay relay 110 VAC input voltage Adjustable from 1–30 min. |
| A1 to A4 | Operational Amplifiers National Semiconductor μa741C - DIP |
| C1 and C2 | 50 V, 0.33 μufd. |
| C3 | 50 V, 10.0 μufd. |
| D1 and D2 | Zener Diodes −2 V at 10 μua. |
| D3–D7 | Silicon Diode IN645 (or equivalent) |
| 17 and 18 | Transistors - National Semiconductor Type 2N2222 |
| LR1 | SPDT Relay, 5 Amp. contacts, coil voltage 20–24 VDC at 1K ohms. |
| R1 and R2 | 1000 ohms (in bridge circuit) |
| R3 | 10K ohms |
| R4, R5, R9–R11, R14 & R15 | 100K ohms |
| R6 | 16.7K ohms |
| R7 | 51.0K ohms |
| R8 | 1 M ohms |
| R12, R13, R16, R17 | 20K ohms |

In some isolated instances, it may be necessary to increase the time interval during which the control and monitoring device of the invention will permit momentary fluctuations of an existing system during the start-up period. To increase this interval, the Zener diodes D1 and D2 may be arranged as in FIG. 6 of the drawing to prevent unnecessary tripping of the system.

Figure 13:
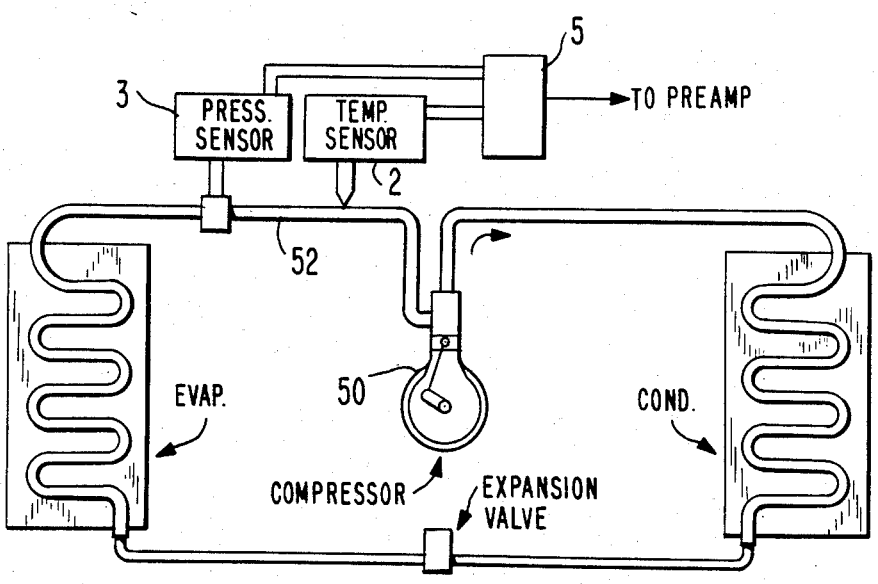
FIG. 13 is a diagrammatic illustration of a conventional refrigeration system using the control device of the invention.

In summary, the present control device protects a compressor 50 against abnormal superheated conditions of a superheated gas in the suction line 52, of a refrigeration system of the type illustrated in FIG. 13. Typically, to maintain a compressor at normal operating temperatures there is a cooperative interaction between the compressor and the refrigerant being compressed. The refrigerant cannot be so hot that it causes the compressor to operate beyond a safe temperature, yet it must be hot enough to insure that there is no liquid in the return (suction) line. Heat in the return line above that required to convert all the liquid to gaseous form is called "super-heat", and is a function of the temperature and pressure within the return line. The superheated refrigerant normally is admitted to the compressor at between about 42 and 55 degrees F., at a pressure ranging between 55 and 70 psig. In order to protect the compressor, the pressure-to-temperature ratio should remain relatively constant, and the control device of this invention is directed to circuitry for monitoring the return line and shutting down the refrigeration system if that ratio deviates from a preset range of values. Both the pressure and temperature of the refrigerant gas in the return line are measured, and the ratio of the output signals from the pressure and temperature sensors 2 and 3 is determined in bridge circuit 5.

The bridge circuit 5 is conventional, and includes a pair of input bridges 40 and 42 which are adjusted to a balanced condition when the respective temperature and pressure sensors 2 and 3 are connected thereto, as shown in FIG. 12. The ratio of the two input bridges at their balanced values is established by adjusting an offsetting ratio network 44, and the bridge circuit is adjusted (calibrated) to produce nominal output; e.g., 7.5 volts when the inputs are balanced, and at the correct ratio. Thereafter, the desired range of operation is established by selecting the desired range resistor (15°, 25°, etc.) and adjusting the throttling range potentiometer 7 in the throttling adjustment network 46, which is a feedback loop for a proportion voltage control amplifier 54 and a series current limiter 56. This range adjustment allows the measured values to fluctuate within a selected normal range without affecting the bridge output.

Once the normal operating range is established, the control system of the present invention functions to provide a safety shut-down (or lock-out) of the system if that range is exceeded, on either the high or low side, by a predetermined amount. Thus, the output of the bridge 5 is supplied to a scaling preamplifier 8, which provides an offset equal to the nominal output voltage from the bridge; e.g., 7.5 volts, and under balanced conditions and within the normal operating range of the system provides a 0 voltage output. If the sensed pressure and temperature exeed (or fall below) the range determined by bridge 5, the preamplifier 8 will produce an output which is integrated in integrator 9, and supplied to comparators 13 and 14. If the supplied voltage exceeds the base voltage supplied to the comparators by more than a preset amount, one of the comparators will supply a voltage to lock-out relay 18, which will shut down the system.

A start-up timer is provided to disable the control device at the start-up of the system, since the measured values will normally exceed the preset deviations during that period.

Having thus described the invention, what is believed to be novel and sought to be protected by letters patent of the United States is as follows:

I claim:

1. Apparatus for quantitatively monitoring the amount of super-heat contained in the refrigerant vapor of an air conditioning refrigeration system and locking-out the refrigeration system in response to sustained variation of the super-heat above or below predetermined quantitative limits defining a "deadband" for longer than selected intervals, comprising:

(a) means for independently sensing the temperature and pressure of the refrigerant vapor and reflecting the sensed values of the temperature and pressure as values of electrical resistance;

(b) a power supply adapted to provide a predetermined regulated output;

(c) a bridge circuit connected to said power supply and to said temperature and pressure sensors and responsive to said values of electrical resistance and calibrated to balance said values of electrical resistance to produce a predetermined electrical output signal correlated quantitatively to said super-heat;

(d) a preamplifier connected to receive said predetermined electrical output signal from said bridge circuit;

(e) an integrator circuit connected to receive the output signal of the amplifier and adapted to produce either a positive or negative output when said super-heat varies from said predetermined value;

(f) a pair of comparator circuits connected to receive the output from said integrator circuit and adapted to produce an output signal through one or the other of two output circuits depending upon whether the output from said integrator is positive or negative and of a predetermined value; and (g) lock-out means responsive to variations in said bridge circuit output above or below said predetermined quantitative limits whereby lock-out timing becomes a function of the amount that said predetermined quantitative limits of super-heat are exceeded.

2. The combination according to claim 1, in which an adjustable start-up timer is provided operatively associated with said integrator circuit and adapted to disble the integrator circuit for a selected predetermined start-up interval when the super-heat varies in value above or below said predetermined limits during the start-up interval.

3. The combination according to claim 2, in which said start-up timer is adjustable to disable the integrator circuit from one to fifteen minutes after start-up of the system.

4. The combination according to claim 1, in which said electrical resistance values reflected by said temperature and pressure sensors vary at different rates, and said bridge circuit includes adjustment means for calibrating the bridge to accommodate the different rates to provide a balanced output from said bridge.

5. The combination according to claim 1, in which said bridge circuit includes a pair of set point adjustment means, a ratio adjustment means for calibrating the bridge circuit in relation to the values of electrical resistance reflected by said temperature and pressure sensors, and a throttling range adjustment means cooperatively related to provide a 7.5 VDC output from said bridge circuit when the inputs to the bridge circuit are balanced.

6. The combination according to claim 1, in which said integrator circuit provides a zero output when the output from said bridge is balanced at 7.5 VDC.

7. The combination according to claim 1, in which said integrator circuit includes means for accommodating a four volt input differential "deadband" from said preamplifier without triggering said integrator into a conductive mode.

8. The combination according to claim 1, in which said bridge circuit includes a set point adjustment means for setting the lower limit of said super-heat value and a set point adjustment means for setting the upper limit of said super-heat value.

9. The combination according to claim 1, in which said two output circuits energized by said output signal from said pair of comparator circuits include a pair of amplifiers.

10. The method of controlling an air conditioning refrigeration system having a compressor unit to prevent the passage of liquid refrigerant into the compressor unit of said system comprising the steps of:

(a) monitoring the temperature and pressure of the gaseous refrigerant at a point in the system between the evaporator and compressor unit to ensure the presence of super-heat in said gaseous refrigerant and generating separate electrical signals correlated to the parameter being sensed;

(b) conditioning said separate electrical signals to produce a single electrical output signal balanced to compensate for inherent differences of signal generation of said separate electrical signals;

(c) amplifying said single electical output signal;

(d) integrating the single electrical output signal to accommodate a range of variations in said output signal between predetermined positive and negative limits correlated to an acceptable range of variations in temperature and pressure of said gaseous refrigerant to produce an integrated output signal that is either positive or negative and of a finite value; and (e) applying said integrated output signal to interrupt operation of the air conditioning refrigeration system when the finite value thereof exceeds a predetermined limit correlated to the presence or absence of a predetermined value of super-heat in the gaseous refrigerant.

11. Apparatus for quantitatively monitoring the amount of super-heat contained in the refrigerant vapor of an air conditioning refrigeration system and locking out the regrigeration system in response to sustained variation of the super heat above or below predetermined quantitative limits defining a "dead band" for longer than selected intervals, comprising:

(a) means for independently sensing the temperature and pressure of the refrigerant vapor and reflecting the sensed values of the temperature and pressure as values of electrical resistance;

(b) a power supply adapted to provide a predetermined regulated output;

(c) a bridge circuit connected to said power supply and to said temperature and pressure sensors and responsive to said values of electrical resistance and calibrated to balance said values of electrical resistance to produce a predetermined electrical output signal correlated quantitatively to said super heat;

(d) timer means responsive to variations in said bridge circuit output; and (e) lock-out means connected to said bridge circuit and responsive to variations in said bridge circuit output above or below said predetermined quantitative limits whereby lock-out timing becomes a function of the amount that said predetermined quantitative limits of super-heat are exceeded.

* * * * *